US010781676B2

(12) United States Patent
Huang et al.

(10) Patent No.: US 10,781,676 B2
(45) Date of Patent: Sep. 22, 2020

(54) THERMAL CUTTER

(71) Applicant: Schlumberger Technology Corporation, Sugar Land, TX (US)

(72) Inventors: Hongfa Huang, Sugar Land, TX (US); Steven Henderson, Katy, TX (US); Moises Enrique Smart, Houston, TX (US); David Presas, Rosharon, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 123 days.

(21) Appl. No.: 15/988,098

(22) Filed: May 24, 2018

(65) Prior Publication Data

US 2019/0186243 A1 Jun. 20, 2019

Related U.S. Application Data

(60) Provisional application No. 62/598,603, filed on Dec. 14, 2017.

(51) Int. Cl.

| | |
|---|---|
| ***E21B 29/02*** | (2006.01) |
| ***E21B 31/16*** | (2006.01) |
| ***E21B 43/1185*** | (2006.01) |
| ***E21B 43/119*** | (2006.01) |
| ***E21B 43/114*** | (2006.01) |

(52) U.S. Cl.

CPC ..... *E21B 43/1185* (2013.01); *E21B 43/114* (2013.01); *E21B 43/119* (2013.01); *E21B 29/02* (2013.01)

(58) Field of Classification Search

CPC ..... E21B 29/02; E21B 31/16

See application file for complete search history.

(56) References Cited

U.S. PATENT DOCUMENTS

| | | | | |
|---|---|---|---|---|
| RE20,832 | E | 8/1938 | Wells | |
| 2,191,783 | A | 2/1940 | Wells | |
| 2,286,075 | A | 6/1942 | Evans | |
| 2,789,004 | A | 4/1957 | Foster | |
| 3,318,381 | A | 5/1967 | Brandt | |
| 4,125,161 | A | 11/1978 | Chammas | |
| 4,216,721 | A | 8/1980 | Marziano et al. | |
| 4,298,063 | A * | 11/1981 | Regalbuto | E21B 29/02 102/308 |
| 4,585,158 | A | 4/1986 | Wardlaw, III | |
| 4,598,769 | A | 7/1986 | Robertson | |

(Continued)

FOREIGN PATENT DOCUMENTS

| | | | |
|---|---|---|---|
| GB | 2065750 | A | 7/1981 |
| WO | WO2013135583 | A2 | 9/2013 |

(Continued)

OTHER PUBLICATIONS

Office Action issued in the related U.S. Appl. No. 15/275,948 dated Jun. 4, 2019, 18 pages.

(Continued)

*Primary Examiner* — Cathleen R Hutchins
(74) *Attorney, Agent, or Firm* — Cameron R. Sneddon

(57) ABSTRACT

A thermal cutter device for cutting downhole objects in a reservoir wellbore, wherein the device lacks moving parts, and thus is more robust and less failure prone than prior art thermal cutter.

19 Claims, 12 Drawing Sheets

(56) References Cited

U.S. PATENT DOCUMENTS

| | | | | |
|---|---|---|---|---|
| 4,619,318 | A | 10/1986 | Terrell et al. | |
| 4,808,037 | A | 2/1989 | Wade et al. | |
| 4,996,922 | A | 3/1991 | Halcomb et al. | |
| 5,129,305 | A | 7/1992 | Reilly | |
| 5,411,049 | A | 5/1995 | Colvard | |
| 5,435,394 | A | 7/1995 | Robertson | |
| 5,833,001 | A | 11/1998 | Song et al. | |
| 6,131,801 | A | 10/2000 | Hagen | |
| 6,186,226 | B1 | 2/2001 | Robertson | |
| 6,598,679 | B2 | 7/2003 | Robertson | |
| 6,766,744 | B1 | 7/2004 | Song et al. | |
| 6,925,937 | B2 | 8/2005 | Robertson | |
| 7,124,820 | B2 | 10/2006 | Wardlaw | |
| 7,290,609 | B2 | 11/2007 | Wardlaw et al. | |
| 7,690,428 | B2 * | 4/2010 | Robertson | E21B 29/02 166/298 |
| 7,726,392 | B1 | 6/2010 | Robertson | |
| 7,900,704 | B2 | 3/2011 | Robertson | |
| 7,934,552 | B2 | 5/2011 | La Rovere | |
| 7,997,332 | B2 | 8/2011 | Robertson | |
| 8,020,619 | B1 | 9/2011 | Robertson et al. | |
| 8,167,044 | B2 | 5/2012 | Huang et al. | |
| 8,196,515 | B2 | 6/2012 | Streibich et al. | |
| 8,235,102 | B1 | 8/2012 | Robertson | |
| 8,327,926 | B2 | 12/2012 | Robertson | |
| 8,336,612 | B2 | 12/2012 | Robertson et al. | |
| 8,474,381 | B2 | 7/2013 | Streibich et al. | |
| 8,662,169 | B2 | 3/2014 | Cortez | |
| 8,685,187 | B2 | 4/2014 | Han et al. | |
| 2005/0072568 | A1 * | 4/2005 | Robertson | E21B 29/02 166/297 |
| 2006/0037750 | A1 | 2/2006 | Wardlaw | |
| 2012/0006547 | A1 | 1/2012 | Robertson et al. | |
| 2012/0055666 | A1 | 3/2012 | Swor et al. | |
| 2012/0199340 | A1 | 8/2012 | Robertson | |
| 2012/0199351 | A1 | 8/2012 | Robertson | |
| 2012/0255742 | A1 | 10/2012 | Cortez | |
| 2013/0112320 | A1 | 5/2013 | Wright | |
| 2014/0034315 | A1 | 2/2014 | Tallini et al. | |
| 2014/0137761 | A1 | 5/2014 | Robertson et al. | |
| 2014/0251612 | A1 | 9/2014 | Powers | |
| 2014/0262249 | A1 * | 9/2014 | Willberg | E21B 43/247 166/251.1 |
| 2015/0034317 | A1 | 2/2015 | Skjold | |
| 2016/0214176 | A1 | 7/2016 | Bruck et al. | |
| 2016/0369597 | A1 | 12/2016 | Robertson et al. | |
| 2017/0241227 | A1 | 8/2017 | Tallini et al. | |
| 2017/0335646 | A1 | 11/2017 | Huang et al. | |
| 2018/0085850 | A1 | 3/2018 | Huang | |

FOREIGN PATENT DOCUMENTS

| | | | |
|---|---|---|---|
| WO | WO2014138444 | A2 | 9/2014 |
| WO | WO2016069305 | A1 | 5/2016 |
| WO | 2016161283 | A1 | 10/2016 |

OTHER PUBLICATIONS

Extended Search Report issued in the related EP Application 17193207.2 dated May 18, 2018 (8 pages).

International Search Report and Written opionion issued in the related PCT application PCT/2015/056161, dated Dec. 21, 2015 (16 pages).

International Preliminary Report on Patentability issued in the related PCT application PCT/2015/056161, dated May 2, 2017 (12 pages).

Yehuda Meir and Eli Jerby, Underwater Microwave Ignition of Hydrophobic Thermite Powder Enabled by Magnetic Encapsulation, Conference: 14th International Conference on Microwave and High Frequency Heating, Nottingham, UK, Sep. 2013 (4 pages).

Exam Report issue in the related EP Application No. 17193207.2 dated Apr. 9, 2019, 6 pages.

Search Report and Written Opinion of International Patent Application No. PCT/US2018/065590 dated Mar. 27, 2019, 13 pages.

Office Action issued in the related U.S. Appl. No. 15/520,853 dated Mar. 19, 2019, 32 pages.

Extended Search Report issued in the related EP Application 15855623.3 dated Jun. 29, 2018 (7 pages).

Office Action issued in the related U.S. Appl. No. 15/275,948 dated Jul. 3, 2018 (20 pages).

Communication pursuant to Article 94(3) EPC issued in the related EP Application 15855623.3 dated Jan. 27, 2020, 6 pages.

* cited by examiner

THERMAL CUTTER

PRIORITY

This application claims priority to U.S. Provisional Application No. 62/598,603 filed Dec. 14, 2017, and is incorporated by reference in its entirety for all purposes.

FIELD OF THE DISCLOSURE

The disclosure relates to a thermal cutter for use in cutting downhole objects in wells, such as in removing well tubing or casing in plug and abandonment operations, removing stuck or deviated tubing or drill pipe, in fishing operations, and the like. The device is thermate based, and uses frangible seals instead of moving parts, and thus is less failure prone than prior art devices. The device connects to a standard perforating and correlation device or other downhole tool deployment means.

BACKGROUND OF THE DISCLOSURE

In oil and gas exploration and production, there is frequently a need to cut downhole objects, such as casing in plug and abandonment operations, cutting of deviated pipe, cutting of tools that have become stuck, and the like. The cutting system necessary for a particular application depends on the well depth, fluid, hydrostatic pressure, temperature, and size, alloy grade, and weight of the tubing (wall thickness) or other metal to be cut. However, the most important factor is any restriction above the cut point and the ability to pull tension on the pipe to recover the separated section or recover parts of the completion. Requirements for cutting tubing include knowledge of the specific design of the well and any restrictions above the point to be cut. Once the cut point is selected, the cutting method should be studied carefully to determine if a clean cut can be made that will require a minimum of overpull to separate the uncut sections of the pipe. Additional considerations include the conveyance system and the manner of depth control that will place the cutter at the correct position.

The most common pipe cutoff methods involve either explosive or chemical cutters. Explosive cutters use the same explosive technology used in perforating charges. Instead of a cylindrical cone, however, the explosive and the liner are arranged in a wedge so that the explosive front will push out on all sides, extruding a liner jet, radially (away from the center) and thereby sever the pipe. Although the technique is effective in most cases, the external part of the pipe is left with a flare that is often difficult to wash over or engage with a grapple or overshoot during pipe recovery operations. Newer explosive cutters have largely reduced this flare to an acceptable level (in optimum conditions), but even so, explosive cutting presents safety concerns and is sometimes unsuitable for a given well intervention.

Mechanical cutters based on milling or mechanical cutting blade design have been used successfully on both jointed and coiled tubing applications to sever pipe. These cutters are considerably slower than the chemical or explosive cutters, and can be run on conventional electric line equipment. High alloy pipes and very thick pipes are more difficult to cut with a mechanical cutter.

Abrasive cutters have been reintroduced recently to the market and have the potential to rapidly sever almost any type of pipe at any depth. These cutters use a particulate such as sand, glass beads, or calcium carbonate. The particulate is pumped through a rotating nozzle, and the abrasion erodes the steel. Cuts through even heavy-walled drillpipe are possible if the cutter can be kept in the same place during the entire cutting operation. Cuts at surface with abrasive cutters are very fast; however, the cutting process is slowed because of backpressure when the cutters are applied downhole. Nonetheless, these cutters are beginning to see extensive use as pipe cutoff tools.

Chemical cutting has become one of the most common pipe cutoff methods, especially for tubing. The cutting fluid reacts extremely quickly and generates intense heat. The fluid is sprayed through a nozzle assembly at the walls of the tubing all around the cutoff tool. As the fluid contacts the steel wall, a vigorous reaction occurs and the pipe is separated smoothly without leaving an external flare. Chemical cutters can produce very smooth cuts, but are very dependent on orientation and centralization, and are generally intolerant of differential pressure between the annulus and tubular.

Thermite cutting devices use a chemical reaction (combustion) to generate intense heat that is used to provide the cutting mechanism. However, the existing prior art devices all rely on moving parts to open a passageway for the hot jet. For example, US20170335646, entitled "Non-explosive downhole perforating and cutting tools" and incorporated by reference in its entirety for all purposes, describes a thermite-based cutter with a "moveable member." When the moveable member is in a closed position the communication path between the reaction chamber and the nozzle is blocked and when the moveable member is in its open position the communication path is opened to allow hot fluid to jet out of the device to effectuate cutting. This moving part is thus a potential source of failure, especially when subject to the extreme conditions resulting from thermite ignitions, debris from poor tubular conditions, or in the corrosive downhole environment.

What is needed in the art are better devices and methods for cutting objects downhole. The ideal device would not have any moving parts, and would generate a clean cut in a short length of time.

SUMMARY OF THE DISCLOSURE

The invention generally relates to a downhole thermite cutter that lacks moving parts to activate the cutting jets, and instead relies on a frangible seal that is melted or fractured and destroyed when exposed to the high pressure, high temperature (HPHT) fluid created on ignition of the thermite.

In more detail, the invention includes any one or more of the following embodiments, in any combination(s) thereof:

A downhole cutting tool, comprising a cylindrical housing containing: a) a reaction chamber comprising a thermite or thermate; b) an igniter in operational contact with said thermite or thermate; c) one or more fluid pathways having a beginning at said reaction chamber and an exit at an exterior of said cylindrical housing; and d) means for a frangible seal positioned between said beginning and said exit or at the exit, said frangible seal configured to break upon application of a threshold pressure inside said reaction chamber, thus bringing said reaction chamber and said exit into fluid communication without the need for any moving parts.

A downhole cutting tool, comprising a housing having a top end, a bottom end and cylindrical walls, said housing containing: a) a reaction chamber comprising a thermate in the form of powder or pellets; b) an igniter in operational contact with said thermate; c) one or more fluid pathways having a beginning at said reaction chamber and traversing through a base of said reaction chamber and having an exit pathway to an exit at an exterior of said cylindrical walls; d) said reaction chamber base being lined with graphite except at said beginning of said fluid pathway; e) said exit pathway being lined with graphite; and f) a frangible seal between said beginning and said exit or at said exit, said frangible seal configured to break upon application of a threshold pressure inside said reaction chamber, thus bringing said reaction chamber and said exit into fluid communication without the requirement of any moving parts.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion. Commonly known details may also be omitted for clarity.

FIG. 3B shows the graphite half annular pieces that line the fluid pathway-3 fluid pathways shown with 6 altogether when the other two pieces (not shown) are added in.

DETAILED DESCRIPTION

Figure 1A:
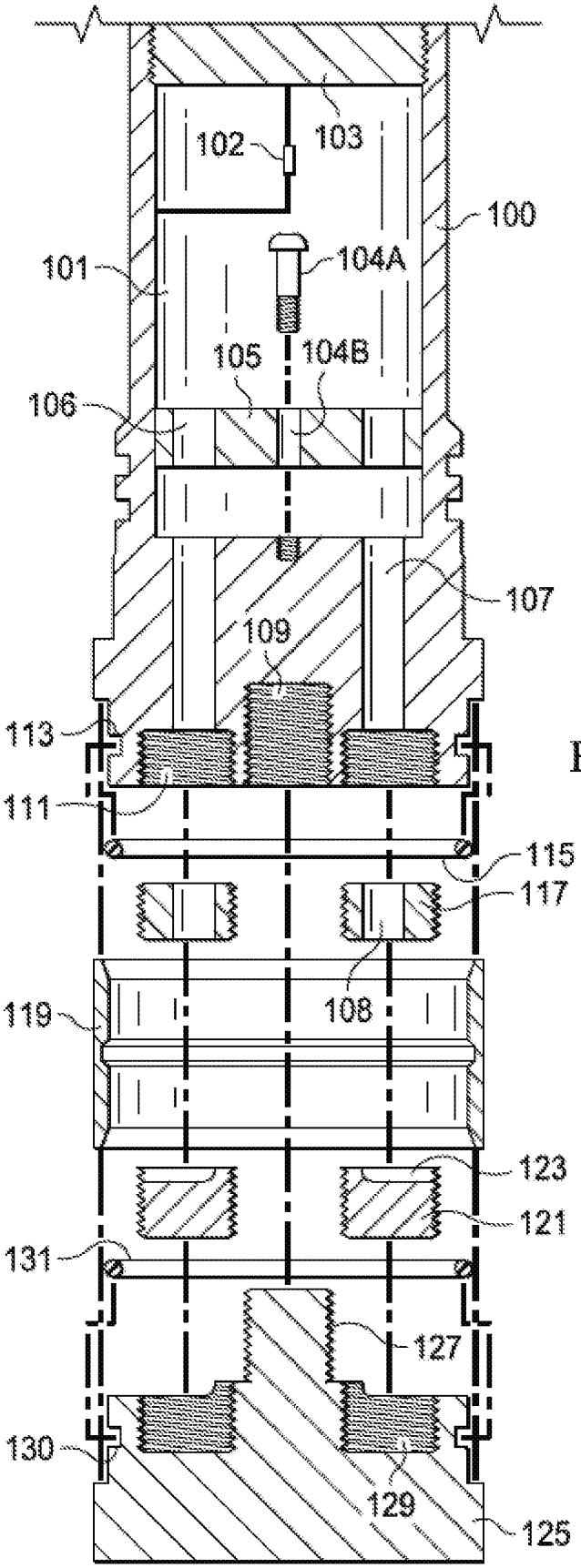
FIG. 1A shows an exploded view of cross sections across the middle of each component of an embodiment of the cutting device of the present disclosure.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms connect, connection, connected, in connection with, and connecting may be used to mean in direct connection with or in connection with via one or more elements, unless it is clear from the context otherwise. Similarly, the terms couple, coupling, coupled, coupled together, and coupled with may be used to mean directly coupled together or coupled together via one or more elements. Terms such as up, down, top and bottom and other like terms indicating relative positions to a given point or element are may be utilized to more clearly describe some elements, and generally refer to usage in a vertical hole, while recognizing that the tools may also be used in a horizontal hole using the same nomenclature.

By "reaction chamber" or "combustion chamber", what is meant is a chamber or space in which the thermite or thermate can be activated to produce the HPHT fluid. Before activation, this chamber typically contains a solid thermite powder or pellets formed of the thermite or thermate powder. The chamber has a top, a base, and annular walls, and typically, channels through the base that connect to exit pathways when activated.

By "jets", what is meant is the high pressure and temperature fluid that exits from the sides of the cutter.

By "fluid pathway" or "fluidic pathway" we refer to a pathway that will eventually be opened when the device is activated, understanding that, in embodiments of the present disclosure, until the cutting device is activated, the pathway is at least partially blocked by a frangible seal. Once the cutting device is activated, the pathway is completed by destruction of the frangible seal, and the jets thereby formed. In certain embodiments, the fluid pathway comprises channels through the base of the reaction chamber and an exit pathway leading from the channels out the side of the housing.

By "channels" what is meant is a fluid pathway or slot that traverses through the base of the reaction chamber from the beginning of the fluidic pathway to the exit pathway. Typically, the channel diameters are larger than the exit pathway diameter (or height if a 360° pathway), providing space for adequate mixing of the hot gas and molten iron or reaction products.

By "exit pathway" what is meant is the fluidic pathway from the channels to the exit point of the fluidic pathway. Once activated, these small exit pathways form the jets. Exit pathways may also be called nozzles.

When we say that the frangible seal is "between" the beginning and the exit, we expressly exclude a seal that lies inside the reaction chamber and before the channels. However, a seal can function and be outside the exit, as shown in FIG. 1.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention, such as instructions for use, buffers, and the like.

The following abbreviations are used herein:

| ABBREVIATION | TERM |
|---|---|
| DST | drillstem test |
| EBW | exploding bridgewire |
| HPHT | High pressure high temperature |
| HTHP | High Temperature, High pressure |
| TCP | Tubing conveyed perforating or tubing conveyed perforator. TCP completion techniques enable perforating very long intervals in one run-some TCP strings have exceeded 8,000 ft [2,440 m] in length-and in highly deviated and horizontal wells TCP is the only means of accessing to the perforating depth. TCP also facilitates running large guns and using high underbalance. When TCP is deployed in conjunction with drillstem test (DST) tools, well fluids can be easily controlled. TCP strings can be retrieved (shoot and pull) or left as part of the permanent completion (integrated completion TCP). |

This disclosure presents embodiments of a cutting device that may be connected to a standard perforating gun conveyance adapter or firing head to become a cutting apparatus for making clean cuts in downhole objects, such as well casing, drill pipe, etc. Tools and techniques for forming perforations in and through casing, cement, formation rock and cutting tubulars in downhole conditions under high pressure are also disclosed. The downhole tool may take the form of a thermite or thermate perforating or cutting device that operates by directing fluids at high temperatures (e.g., approximately 2500-3500° C. or higher) towards objects to be perforated or severed. The hot gas and/or liquid metal is projected outwardly from the tool under pressure and may melt, burn and/or break the objects, such as tubing or casing.

The cutting device of the present disclosure has a thermite or thermate reaction chamber with ignitor that is fluidly connected to a nozzle or exit pathway. Preferably, the chemical used is a thermate, which has lower ignition temperature than the corresponding thermite. The nozzle or exit pathway, however, is not open until deployment, as it is sealed by a frangible seal which can be ruptured under sufficient internal pressure. The number and placement of nozzles as well as the amount and type of thermite/thermate can be used to control where the tool merely perforates casing or severs it completely. The placement and style of the frangible seal can also vary.

The chemical reaction of thermite or thermate material inside the combustion chamber produces high temperature and high pressure (HPHT) fluid, which breaks through the sealing barrier, jetting out of the device to provide a HPHT cutting jet. The frangible seals are designed to open under designated conditions while maintaining sealing to protect tool integrity for hydrostatic and pressure transients in operational deployment. The HPHT jets cut the down hole objects without detonation and accompanying shock disturbances inside the wellbore. Importantly, the cutting device does not rely on any moving parts in creating the hot jets, but rather relies on the high temperature and/or pressure to destroy the seal(s). This is different from conventional cutters that rely upon moving parts to open fluidic pathways.

Thermite is a combustible composition of metal powder, which serves as fuel, and metal oxide. When ignited by proper amount of heat energy, thermite undergoes an exothermic reduction-oxidation (redox) reaction. Most varieties are not explosive, but can create brief bursts of heat and high temperature in a small area. Its form of action is similar to that of other fuel-oxidizer mixtures, such as black powder. Thermites have diverse compositions. Fuels include aluminum, magnesium, titanium, zinc, silicon, and boron. Aluminum is common because of its high boiling point and low cost. Oxidizers include bismuth(III) oxide, boron(III) oxide, silicon(IV) oxide, chromium(III) oxide, manganese(IV) oxide, iron(III) oxide, iron(II,III) oxide, copper(II) oxide, and lead(II,IV) oxide. Table 1 shows some exemplary thermite ingredients.

TABLE 1

| thermite compositions | | |
|---|---|---|
| Metal Fuel | Metal oxide | Metal Nitrate |
| Al, Be, Cu, Mg, Fe, Si, Ti, Zr, Zn | $Bi_2O_3$, CoO, $Co_3O_4$, $Cr_2O_3$, CuO, $Cu_2O$, $Fe_2O_3$, $Fe_3O_4$, FeO, $I_2O_5$, $MnO_2$, NiO, $Ni_2O_3$, $PbO_2$, PbO, $Pb_3O_4$, $SnO_2$, $WO_2$, $WO_3$ | $LiNO_3$, NaNO3, $KNO_3$, $Mg(NO_3)_2$, $Ca(NO_3)_2$, $Sr(NO_3)_2$, $Ba(NO_3)_2$ |

Exemplary reactions include:

$$8Al+3Fe_3O_4 \rightarrow 4Al_2O_3+9Fe$$

A metal nitrate, for example, strontium nitrate decomposes into strontium nitrite:

$$Sr(NO_3)_2 \rightarrow Sr(NO_2)_2+O_2$$

And then further decomposes to:

$$Sr(NO_2)_2 \rightarrow SrO+NO+NO_2$$

Strontium nitrate exists as tetrahydrate, $Sr(NO_3)_2$ $4H_2O$. It can be obtained by recrystallization from a solution in water, it can transfer to anhydrous above 100° C. In a closed chamber, e.g., one mole (211 grams) of Strontium Nitrate, offers 2 moles gas. The sensitivity of the mixture depends on the powder mesh size.

Thermate is a variation of thermite and is an incendiary composition that can generate short bursts of very high temperatures focused on a small area for a short period of time, and is the preferred activator for the cutter described herein. The main chemical reaction in thermate is the same as in thermite: an aluminothermic reaction between powdered aluminum and a metal oxide. However, in addition to thermite, thermate also contains sulfur and sometimes barium nitrate, both of which increase its thermal effect, create flame in burning, and significantly reduce the ignition temperature.

A nano-thermite or nano-thermate can also be employed in embodiments of the present disclosure. Nano-sized thermite is a metastable intermolecular composite (MICs) characterized by a particle size of its main constituents, a metal and a metal oxide, under 100 nanometers. This allows for high and customizable reaction rates. Nano-thermites contain an oxidizer and a reducing agent, which are intimately mixed on the nanometer scale. MICs, including nano-thermitic materials, are a type of reactive materials investigated for military use, as well as for general applications involving propellants, explosives, and pyrotechnics.

The molten metal may be broken down into fine drops in the HPHT environment and a product jet of high temperature gas and the molten metal is pushed out by the pressure to perform the cutting or perforating. The molten metal may exit the tool under pressure by gas jets shooting through ports or nozzles in the tool.

In an embodiment of the present disclosure, the ignition method for the material is the same as stated in previous patent applications (US20170335646A1). However, the igniter may take any suitable form (e.g., electric, chemical) and in some embodiments may take the form of an exploding bridgewire (EBW). The EBW igniter may be one marketed and sold by Teledyne, Inc., for example an SQ-80 igniter which is a thermite filled exploding bridgewire igniter. The EBW ignites the thermite in the igniter and ignites the energy source, e.g., thermate material. In some embodiments, the igniter may be provided in multiple parts. For example, the igniter may be provided in two parts, for example the EBW and a thermite pocket, and the parts may remain separated until the downhole tool is ready to be used at a field site.

Other examples of igniters that can be used in embodiments of the present disclosure include without limitation, electrical spark and electrical match igniters that are in contact with the energy source or in contact with a thermite material and chemical igniters. Additionally, the igniter may be positioned at any suitable position within the carrier body. For example, the igniter may be positioned at or near the top, at or near the bottom, or any position in the middle and in contact with the energy source. If the igniter is not embedded in the energy source material or within a distance to ignite the energy source then it may be connected by a fuse cord utilizing a non-explosive energetic material such as thermite or thermate. A fuse cord may also be utilized to connect multiple tools to fire in sequence.

Embodiments of the cutting device of the present disclosure are shown in the following figures and will be described in detail. A series of varying cutter sizes (diameters) can be selected to minimize restriction and fit the target pipe to be cut. The conveying equipment is similar to conventional perforating operations (Slickline, electric line, wireline, coiled tubing, etc.), and is not detailed herein.

FIG. 1A shows an exploded cross-section through the middle of an embodiment of the cutting device. In this embodiment, there are two main parts, although there are several additional components. The upper half is an adaptor 100 for connecting a combustion chamber 101 to a base 125. These two parts connect via a threaded receptacle 109 on an adaptor 100 to a threaded post 127 in the base 125. However, these two parts could be reversed and other connection means are possible. The two parts (100 and 125) are made separately so that a thin walled steel sleeve 119 (1-20 mm) can be fit over the bottom end of the adapter 100 and the top end of the base 125 such that the surface of the sleeve 119 and the remainder of the tool are flush. Optional grooves 113/130 and o-rings 115/131 seal the sleeve 119.

Also shown are several graphite pieces which serve to protect the metal parts from the hot fluid. In the embodiment shown, disc shaped graphite disc 105 has holes 106 therein that align with corresponding slots or channels 107 in the adaptor 100. These channels are shown exiting the base of the reaction chamber, but they could also exit the side. However, exiting the base provides the best arrangement in a limited space, and allows gravity to benefit the flow. Also shown is a screw 104*a* and a screw hole 104*b*, used to hold the graphite disc 105 in place at the bottom of the reaction chamber 101. This connector means is only one possible means, however.

In the embodiment shown, additional graphite components protect the exit pathway. Threaded graphite inserts 117 protect the base of the channel 107 and fit into threaded or clearance fit receptacles 111 in the adaptor 100, having holes 108 that align with the channels 107. In a slip-clearance fit, the graphite components are supported by the steel and retained by assembly of the steel components or epoxy to prevent flow through of the combusting thermite or thermate.

Matching graphite protectors 121 threadedly fit into threaded receptacles 129 in the base 125. These components 121 have a slot 123 on at least one of the facing surfaces thereof, that forms the initial fluid flow pathway.

Figure 1B:
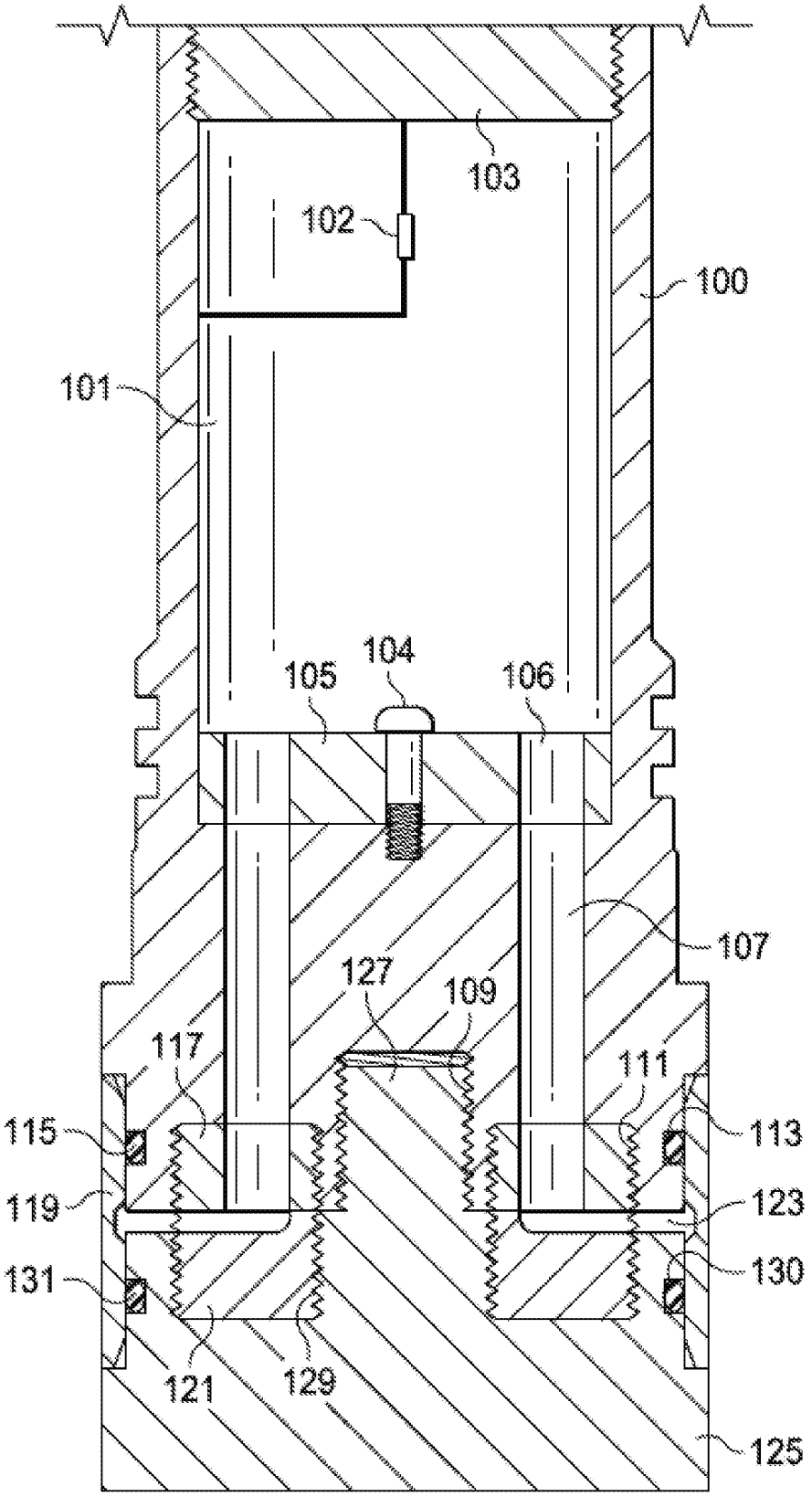
FIG. 1B shows a cross section of an embodiment of the assembled cutting device, wherein upper portions of the cutting device are simplified and/or omitted for clarity (see instead US20170335646, incorporated by reference in its entirety for all purposes).
Figure 1C:
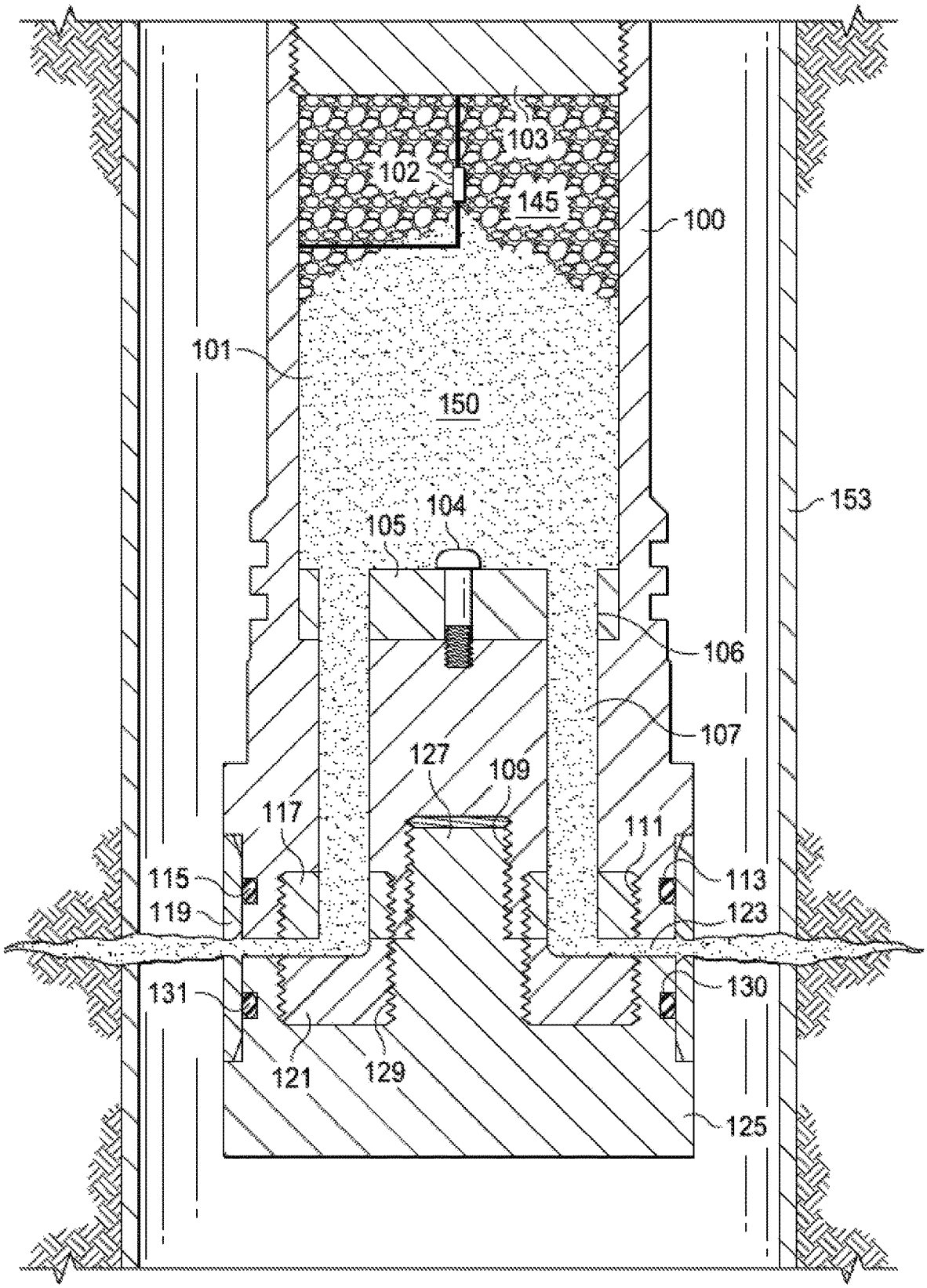
FIG. 1C shows an embodiment of the cutting device after activation of the ignitor, wherein the HPHT jets are cutting through the casing and into the reservoir.

FIG. 1B shows an embodiment of the cutting device assembled, and FIG. 1C shows an embodiment of the cutting device in use in a reservoir 180. Here the device is suspended by wireline, slickline, coiled tubing or other support 170 and is deployed to a location where the casing 165 is to be cut. The thermate 145 is ignited, and the HPHT fluid 150 is forced down the channels 107 to melt the sleeve 119 at the location depicted by reference number 163 thereby producing jets 160 which cut the casing 165 at location 163. In this embodiment, there are 6 jet exits radially arrayed around the long axis of the tool, but 3, 4, 5, 6, or 7 channels or a 360° arc can be provided.

It should be known that the thin-wall sleeve 119 can be a variety of dimensions and in some embodiments, an O-ring in the nozzle can be used. The nozzle gap can be one or a series of small holes on the graphite ring and the holes/channels can be in various patterns.

Figure 2A:
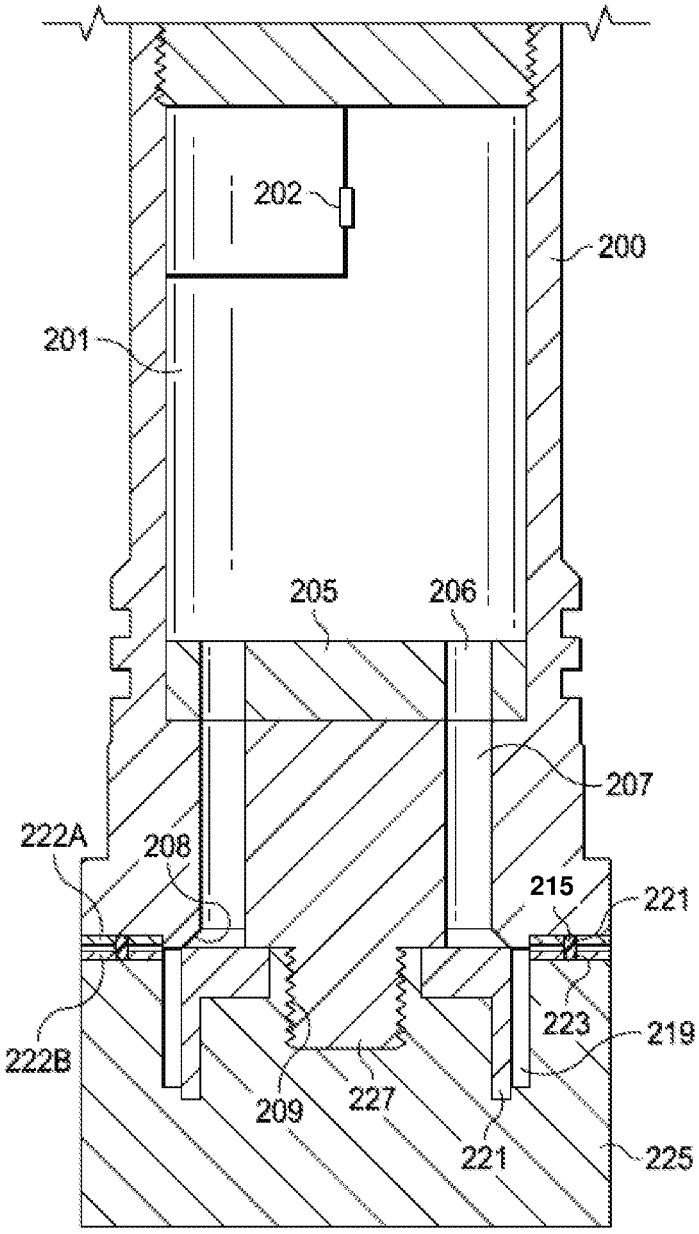
FIG. 2A illustrates another embodiment of the cutting device, wherein a low pressure sink accelerates HPHT fluid flow around the corner and past the O-ring to form jets. The jets can be individual jets or can be a full 360° radial jets, as desired and based on the interior geometry of the channel(s) and the exit pathway(s).

FIG. 2A shows another embodiment of the cutting device, wherein the frangible portion is an o-ring 215 in grooves 221/223 in the adaptor 200 and the base 225. In this embodiment, a low pressure sink 219 is a drilled blind slot that serves to accelerate the HPHT fluid down the channel 207 and around the channel corner 208, blasting past the o-ring 215 to shoot out the interface between the adaptor 200 and the base 225. In this embodiment, the graphite protectors (221 and 222) are drop-in pieces that can be friction fit, adhered, screwed, riveted, or otherwise fastened into the receptacles for the same. The graphite protectors 221 protect the base of the channel 207 and side of the sink 219, and additional graphite protectors 222*a/b* line the fluid path to the jets, but the shape, number and configuration of graphite protectors is variable, and may in some embodiments be optional.

Figure 2B:
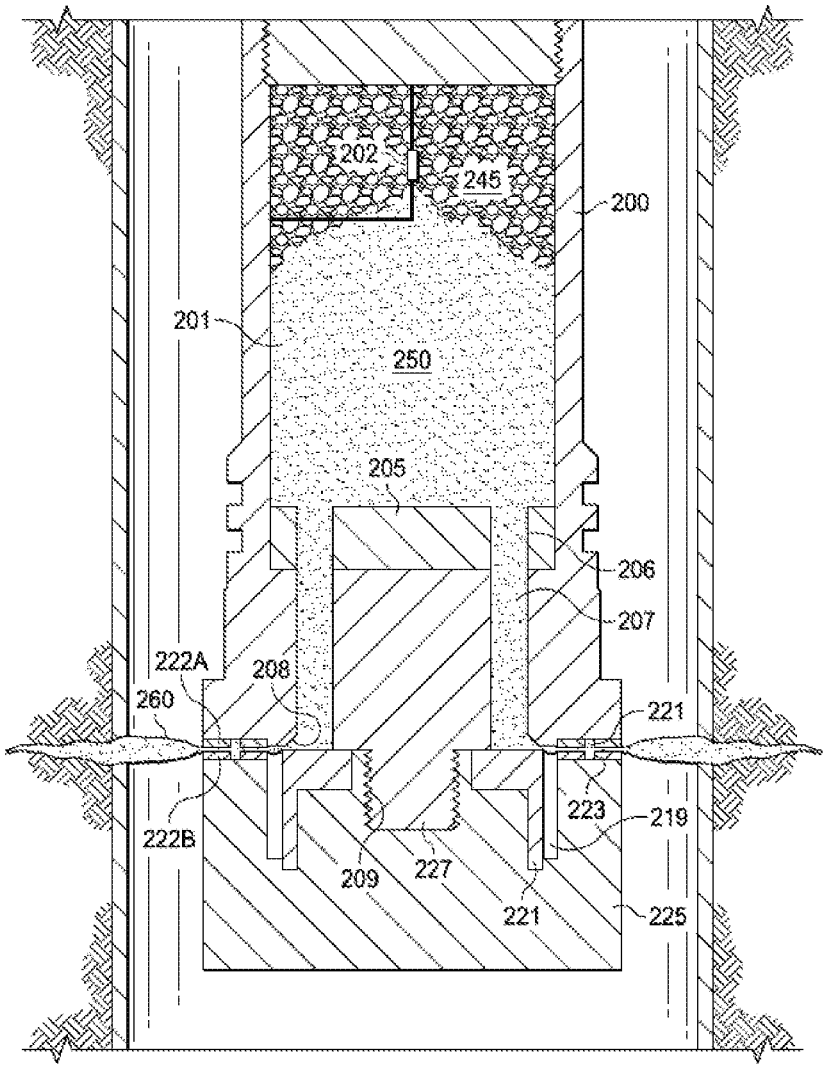
FIG. 2B shows tan embodiment of the cutting device in FIG. 2A after activation, wherein the HPHT fluid has melted a pathway past the O ring to the outside of the cutting device, thus forming the jets. Herein the exit pathway (aka nozzle) is a thin 360-degree ring, formed by joining two parts. The nozzle surface is preferably made of graphite material and may be any pattern other than 360-degree, for example, can have circular nozzle to make small or large holes on objects.

The embodiment of the cutting device shown in FIG. 2A is similar to that described in FIG. 1, except that the threaded receptacle 209 is in the base and the threaded post is in the adaptor 200, which is opposite to that of the embodiment illustrated in FIG. 1. Thus, the graphite disc 205 with holes 206 sits at the base of the reaction chamber 201 with the ignitor 202 therein. FIG. 2B shows the HPHT fluid 250 travelling down the channel 207, around the channel corner 208 and melting a pathway between the two parts, past the now melted o-ring 215, thus creating the jet.

FIG. 3 shows yet another embodiment, wherein a thin layer 319 (0.01-10 mm) at the base of the channel 307 in the adaptor 300 provides the frangible seal. The thickness of the thin layer 319 is controlled by the placement and size of the channels 307, e.g., by drilling or machining the tubular channels. Here the graphite protectors consist of one or two pairs of semicircular washers 321*a/b* (see FIG. 3B, 3D, 3E) that slide into a space left for these components. Once the ignitor 302 is activated as in FIG. 3C, the thermite or thermate 345 will ignite and the HPHT fluid will travel past the graphite disc 305 and down the channel 307, melting the thin metal 319 at the base thereof, and then travel sideways along an exit pathway in the graphite component(s) 321 to provide jets 360.

Figure 3A:
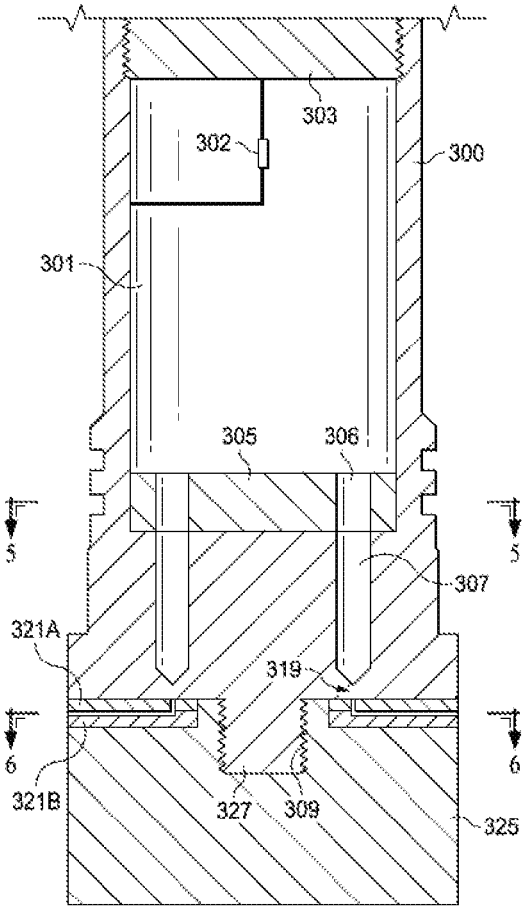
FIG. 3A illustrates another embodiment of the cutting device of the present disclosure, wherein the frangible seal is created by leaving a thin wall of metal between the channel and the fluid pathway at the bottom of the channels. In this embodiment, the exit pathway is lined with graphite.
Figure 3B:
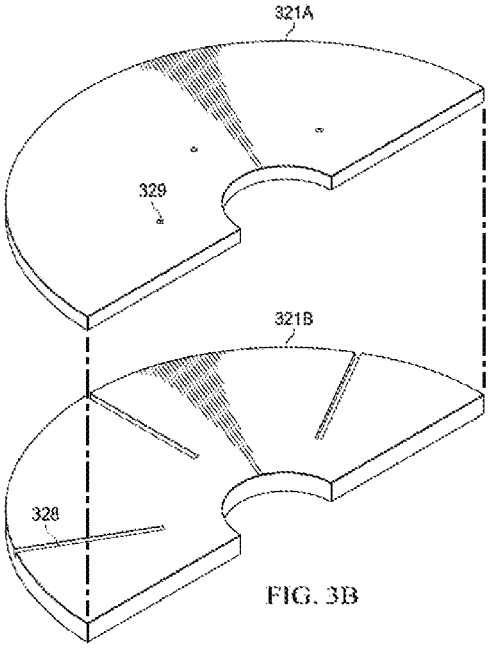
Figure 3C:
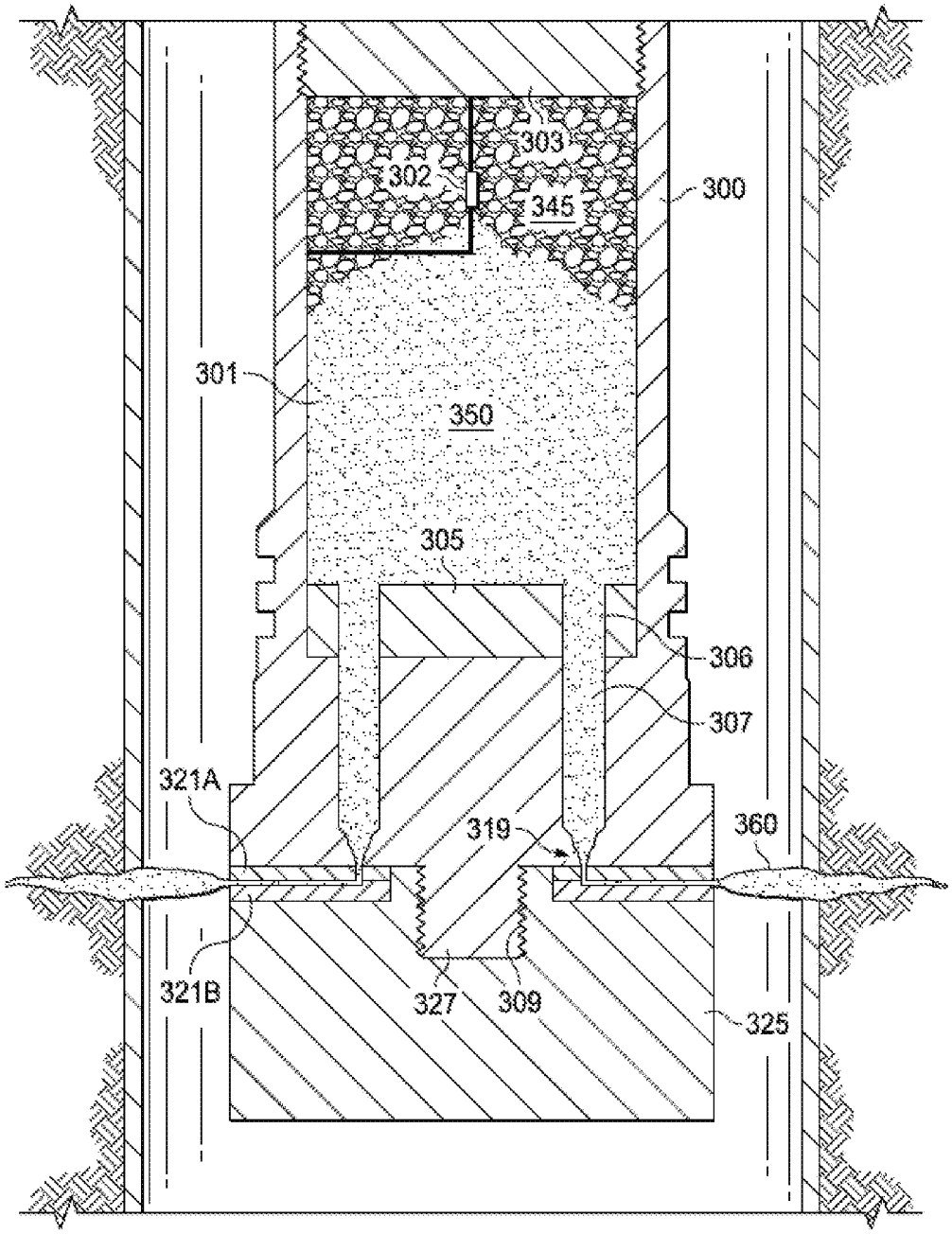
FIG. 3C shows a cross section of an embodiment of the cutting device after activation, cutting through the casing and into the formation.
Figure 3D:
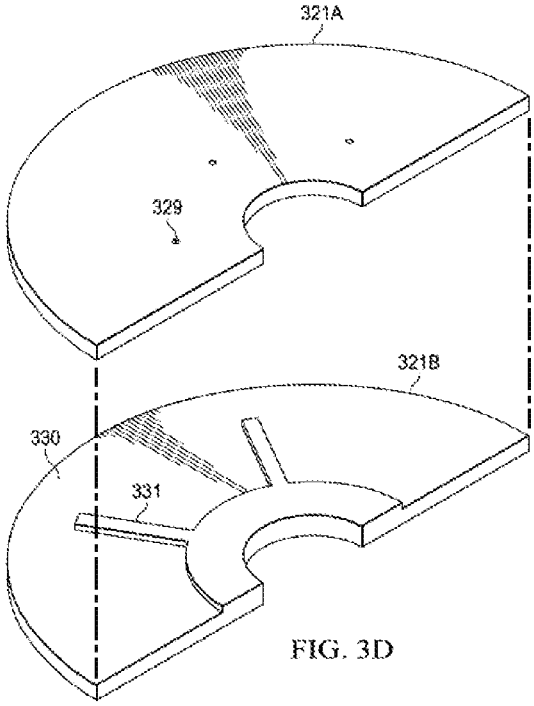
FIG. 3D shows a different embodiment of the graphite half annular piece providing a 360° cutter and having some support struts.
Figure 3E:
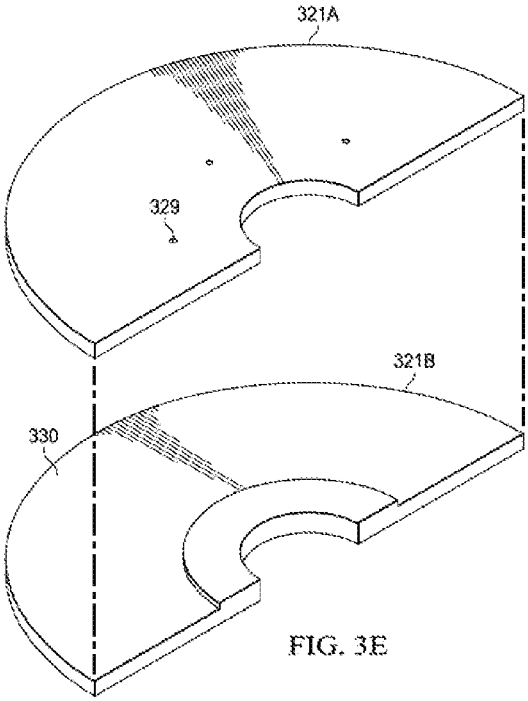
FIG. 3E shows a different embodiment of the graphite half annular piece providing a 360° cutter but without any supporting structures.

FIGS. 3B, 3D, and 3E show various graphite protectors in the 321*a*/321*b* in the form of a half annular disc. In FIG. 3B, three fluid pathways are shown, formed by slot 326 in the lower ring 321*b* and holes 329 in the upper ring 321*a* that align with slots 328. However, the slots could be in the upper ring or the lower ring or both, so long as the rings are inserted so that the slots are on the inner surface and the holes align with the base of the channel 307.

In FIGS. 3D and 3E, 360° cutters are shown wherein the fluid pathway travels from holes 329 out in a 360° arc from the device. In FIG. 3D additional support struts 321 help to support the upper half ring 321*a*, and are positioned to lie between the holes 329, thus not blocking fluid flow, but these are optional as shown in FIG. 3E.

These half annular rings are a way of providing the exit pathway, as the same tool can be used for a variety of different cutting styles merely by changing the etching on these half rings. In addition, the half rings are easily installed into the groove or space from the sides of the annular housing.

Figure 4A:
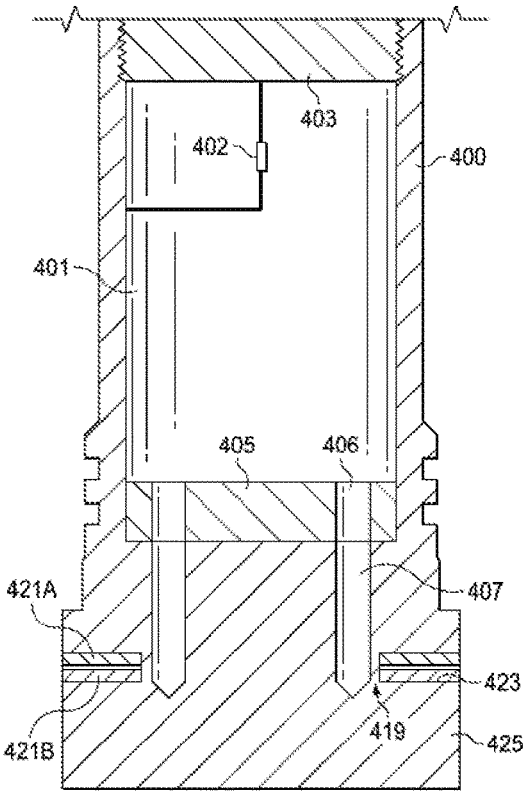
FIG. 4A illustrates another embodiment of the cutting device of the present disclosure where the HPHT fluid flows into channels at a temperature and speed that can effectively break the thin-wall metal at the side and bottom of the channels. As above, the exit pathway is protected by one or more graphite plates (half annular rings or half washers).
Figure 4B:
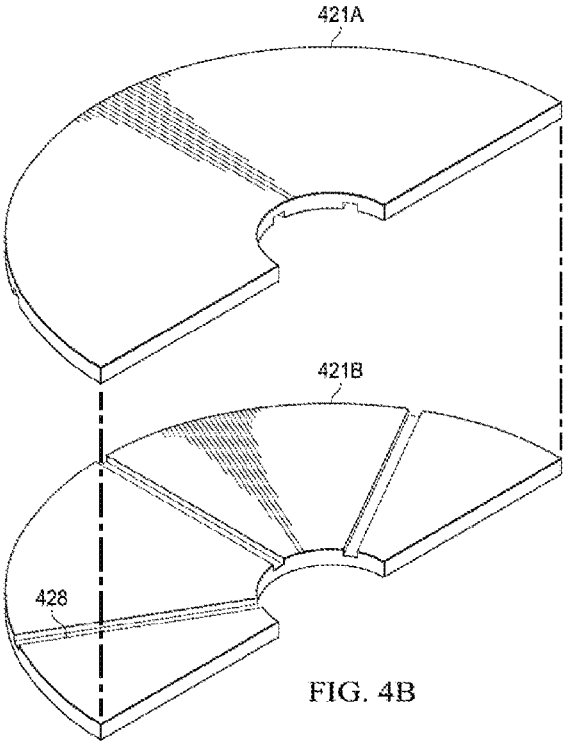
FIG. 4B shows an embodiment of the graphite protectors (top and bottom) where only the bottom piece is etched or grooved to provide the fluid pathway-3 pathways shown, but together with the other side making a total of 6.
Figure 4C:
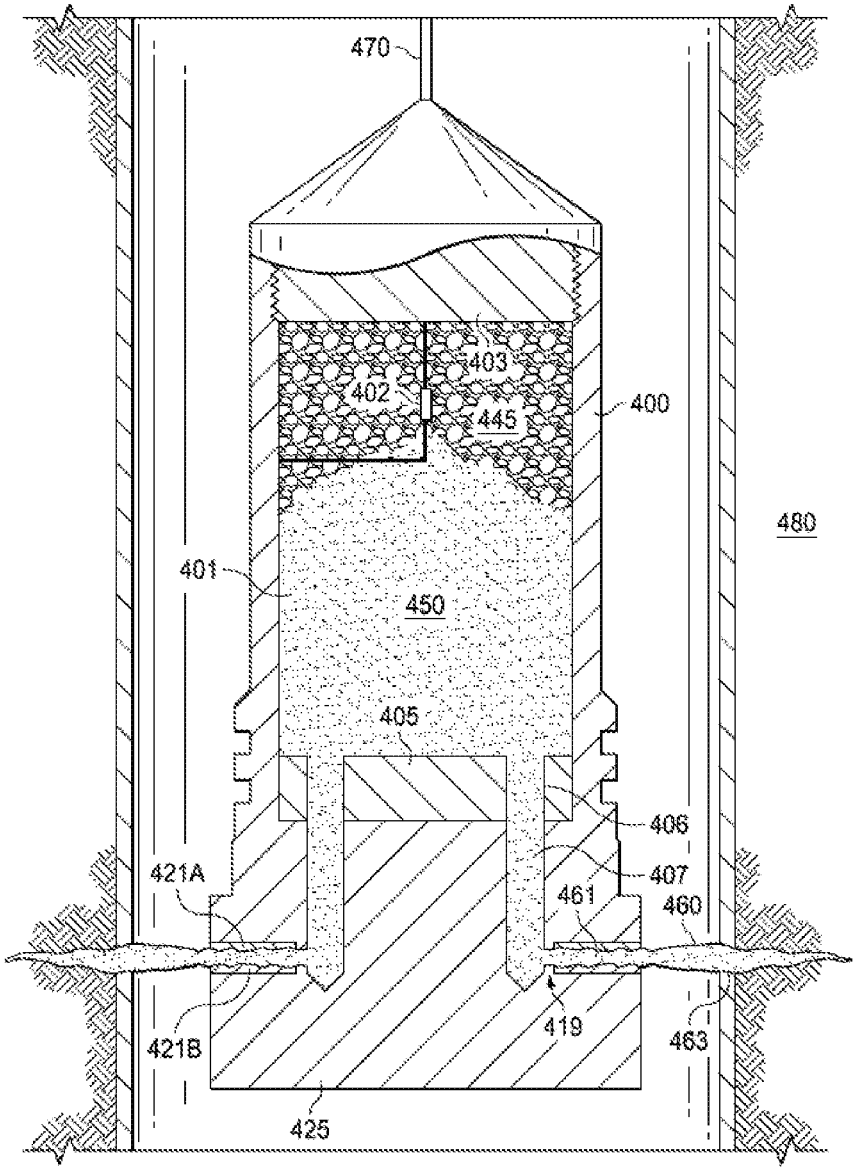
FIG. 4C shows an embodiment of the cutting device after activation, where the fluid pathway is complete and the jets are formed.

FIG. 4A-C show yet another embodiment wherein, if desired, the base and the adaptor can be combined into a single piece deployed via a deployment line 470. Here, an annular groove is machined around the circumference of the cutting device 400 at the location where the jet is intended to exit. Half annular washers 421*a/b* can be fit thereinto from the side, and can be friction fit thereinto or otherwise coupled to the cutting device 400. The groove is machined deep enough to leave only a thin wall of metal 419 between channel 407 and the graphite protectors 421, which are shown in more detail in FIG. 4B. Here, slots 428 are shown in both bottom 421*b* and top 421*a* pieces. When the HPHT fluid cuts through the thin metal 419 on the side of the channels 407, the HPHT fluid will travel down the exit pathway created by the aligned slots 428, thus jetting out of the cutting device 400.

In use, the ignitor initiates the combustion of the thermate 445 in the combustion chamber 401 as in FIG. 3C, creating HPHT fluid 450 which travels through the graphite disc 405 and down the channel 407. The HPHT fluid 450 melts through the thin metal wall 419 and travels along the flow path 461 between the graphite components 421*a/b* to jet out the side. The jet cuts a hole 463 in the casing 465 and cuts partially into the reservoir 480. Depending on the geometry of the slots 406 and the amount of thermite or thermate it is possible to either perforate or completely sever the casing 465.

Figure 5A:
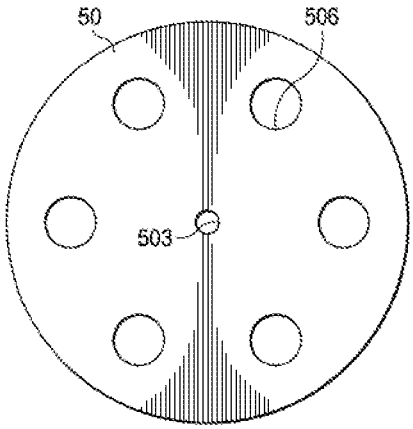
FIG. 5A illustrates a top view of a 6-hole embodiment of the graphite disc that lines the bottom of the reaction chamber.
Figure 5B:
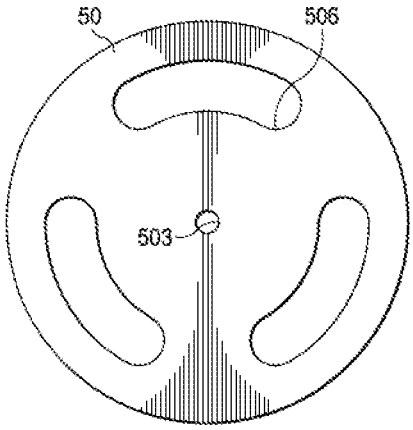
FIG. 5B shows a 3-hole embodiment of the graphite disc. The channels leading out of the reaction chamber will be of the same geometry so that the holes match up with the channels.

FIGS. 5A and 5B show a couple of different hole configurations 506 as reflected by the graphite disc 500, and also seen is optional connector hole 503. In FIG. 5A there are 6 circular channels 506, and in FIG. 5B there are three channels 506 that are arcuate in a horizontal cross section.

Figure 6:
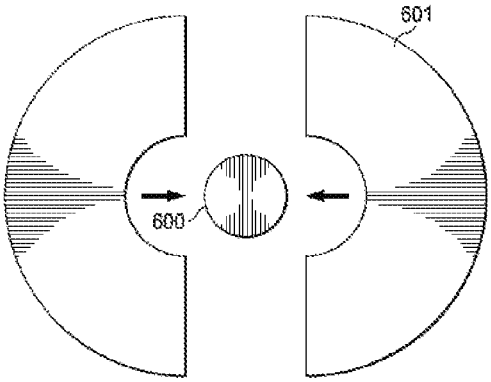
FIG. 6 shows a top view of half annular graphite protectors, which slip into a groove provided for same (see arrows) in the cutting device body.

FIG. 6 shows the half annular rings 601 made of graphite as referenced in FIG. 3 and FIG. 4 that fit into the device 600 from each side.

Figure 7:
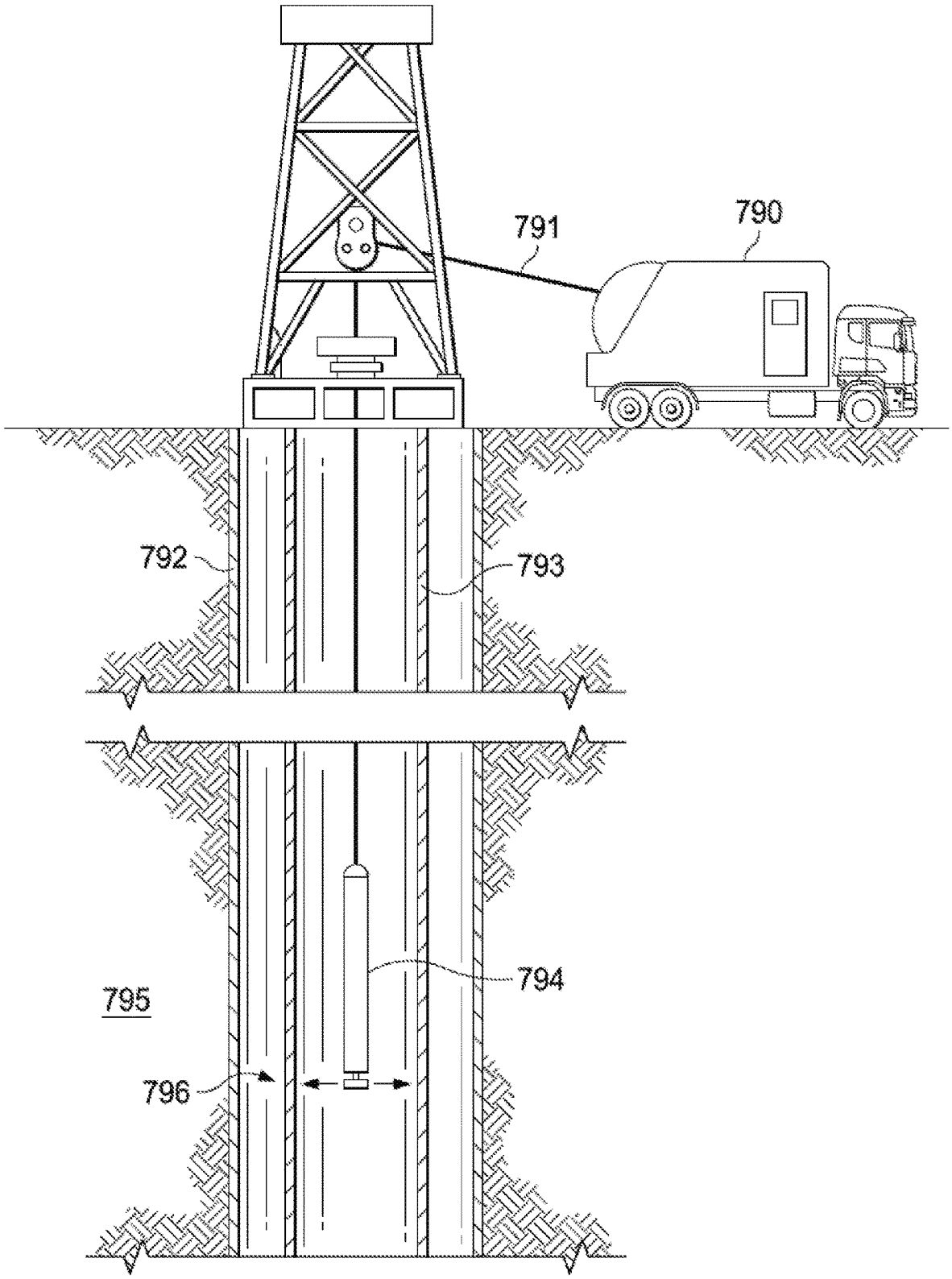
FIG. 7 provides an illustration of an embodiment of the cutting device of the present disclosure deployed downhole in an oil/gas well in a reservoir.

In FIG. 7, an embodiment of the cutting device 794 is shown deployed downhole in an oil/gas well. When the cutting device 794 is connected to a standard perforating gun carrier and other accessories, and is activated, it becomes a thermal cutter. The cutting device 794 can be deployed by wireline 791, TCP conveyed tools, or other known conveyance methods. Seen here is an oilfield service truck (wireline, electric line, or slickline) 790 deploying cutter 794 via wireline 791 down the well 792 in the formation 795 to cut the casing 793 at a location 796. Once ignited, the cutter jets (see arrows) will cut the casing 793.

After the cutting operation, there may be debris left inside the well, which might need to be collected depending on the well requirements. The debris may be iron, aluminum oxides, and strontium metal. Gases such as oxygen, nitrogen oxides, combustion products, and generated water vapor or generated gases may resolve in wellbore fluid or float to top of the well, while cooling down.

The size of the cutting device is such that it is of slightly smaller diameter than the casing to be cut, so that it fits into the well. Thus, the cutting device may be provided in a variety of diameter sizes. Preferably, there is enough annulus distance between the cutting device and the tubular to prevent possible welding of the cutting device to the tubular object (e.g., 0.5-2 cm). In some embodiments, a centralizer may be needed to have an even cut, depending on the amount of clearance.

In some embodiments, the HPHT gas jetting out of the cutter creates a pressure disturbance inside the wellbore, which may make a perforating anchor device necessary to mitigate the cutting device jump and the potential damage to down-hole equipment.

The present disclosure is exemplified with respect to the embodiments shown in FIG. 1-7, but these are exemplary only, and the invention can be broadly applied to other configurations of a combustion chamber and a frangible sealed fluidic pathway. In particular, it is noted that figures are not drawn to scale, and that proportions and layout of design elements can vary, and that there may be fewer or greater numbers of components, depending on how one chooses to assemble the device. Further, this cutter can be combined with other tools, for example, wiper plugs may be suspended below the cutter so as to clean the pipe before cutting, or the tool can be combined with centralizers, and the like.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening parts, a nail and a screw are equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A downhole cutting tool, comprising:

a cylindrical housing a reaction chamber formed within the cylindrical housing, the chamber comprising a thermite or thermate;

an igniter in direct contact with the thermite or thermate;

one or more fluid pathways having a beginning at the reaction chamber and an exit at an exterior of the tool; and a frangible seal positioned between the beginning and the exit or at the exit, the frangible seal configured to break upon application of a threshold pressure inside the reaction chamber, thus bringing the reaction chamber and the exit into fluid communication without any moving parts.

2. The downhole cutting tool of claim 1, further comprising one or more connectors for connection to a separate downhole tool or wireline.

3. The downhole cutting tool of claim 1, wherein the one or more fluid pathways is at least partially lined with graphite.

4. The downhole cutting tool of claim 1, wherein a base of the reaction chamber is lined with graphite.

5. The downhole cutting tool of claim 1, wherein the tool provides a plurality of fluid pathways and the cutting tool perforates a casing at a plurality of exits.

6. The downhole cutting tool of claim 1, wherein the tool provides a 360° cut.

7. A downhole cutting tool, comprising:

a housing having a top end, a bottom end and cylindrical walls;

a reaction chamber formed within the housing comprising a thermate in the form of powder or pellets;

an igniter in operational contact with the thermate;

one or more fluid pathways having a beginning at the reaction chamber and traversing through a base of the reaction chamber and having an exit pathway to an exit at an exterior of the cylindrical walls;

the reaction chamber base being lined with graphite except at the beginning of the fluid pathway;

the exit pathway being lined with graphite; and a frangible seal between the beginning and the exit or at the exit, the frangible seal configured to break upon application of a threshold pressure inside the reaction chamber, thus bringing the reaction chamber and the exit into fluid communication without the requirement of any moving parts.

8. The downhole cutting tool of claim 7, further comprising a connector at a top end of the cylindrical housing for connection to a downhole tool or wireline.

9. The downhole cutting tool of claim 7, further comprising a connector at a bottom end of the cylindrical housing for connection to a downhole tool.

10. The downhole cutting tool of claim 7, wherein the frangible seal comprises a tubular sleeve surrounding the cylindrical housing at the exit and configured to be flush with the exterior of the cylindrical walls.

11. The downhole cutting tool of claim 7, wherein the frangible seal comprises one or more o-rings.

12. The downhole cutting tool of claim 7, wherein the fluid pathway comprises a channel through the base of said reaction chamber, wherein a thin layer of the base separates the channel and the exit pathway, the thin layer being the frangible seal.

13. The downhole cutting tool of claim 12, the fluid pathway further comprising a low pressure sink between the channel and the exit pathway configured to accelerate a flow of a fluid along the fluid pathway to the exit.

14. The downhole cutting tool of claim 7, wherein the graphite lining the exit pathway is in the form of right and left pairs of half annular washers having one or more exit pathways there between, the right and left pairs of half annular washers fitting into a groove circumnavigating an exterior of the cylindrical housing.

15. The downhole cutting tool of claim 7, wherein the tool provides a plurality of fluid pathways and the cutting tool can perforate a casing at a plurality of exits.

16. The downhole cutting tool of claim 7, wherein the channels have a circular cross-section.

17. The downhole cutting tool of claim 7, wherein the tool provides a 360° cut.

18. The downhole cutting tool of claim 7, wherein the thermate comprises a mixture of 5-50% of aluminum powder, 5-50% of iron oxides, and 5-50% of strontium nitrate or barium nitrate, 1-5% sulfur.

19. The downhole cutting tool of claim 7, wherein the thermate comprises a mixture of 65-75% thermite, 25-35% barium nitrate, and 1-3% sulfur, plus a binder.

* * * * *